United States Patent [19]

Babbitt

[11] 4,013,428

[45] Mar. 22, 1977

[54] COAL GASIFICATION PROCESS

[75] Inventor: Robert P. Babbitt, Granada Hills, Calif.

[73] Assignee: The Marquardt Company, Van Nuys, Calif.

[22] Filed: Jan. 26, 1976

[21] Appl. No.: 652,081

[52] U.S. Cl. ..... 48/202; 48/197 R; 48/210; 110/28 R; 252/373; 423/580

[51] Int. Cl.[2] ..... C10J 3/46

[58] Field of Search ..... 48/202, 210, 197 R, 48/DIG. 4; 252/373; 431/190; 110/28 F, 28 R; 423/580

[56] References Cited

UNITED STATES PATENTS

| | | | |
|---|---|---|---|
| 2,713,590 | 7/1955 | Palmer et al. | 48/DIG. 4 |
| 2,716,055 | 8/1955 | Pearce | 48/DIG. 4 |
| 2,767,233 | 10/1956 | Mullen et al. | 48/212 |
| 2,803,530 | 8/1957 | Ludeman | 48/DIG. 4 |
| 3,074,469 | 1/1963 | Babbitt et al. | 431/285 |
| 3,607,157 | 9/1971 | Schlinger et al. | 48/197 R |
| 3,715,195 | 2/1973 | Tassoney et al. | 48/197 R |
| 3,779,725 | 12/1973 | Hegarty et al. | 48/202 |

*Primary Examiner*—Robert L. Lindsay, Jr.
*Assistant Examiner*—George C. Yeung
*Attorney, Agent, or Firm*—Robert E. Geauque

[57] ABSTRACT

A process for gasification of coal by combustion of a fuel and oxidizer in a preburner to produce steam at a temperature substantially above the minimum temperature at which steam and coal will react to produce carbon monoxide and hydrogen and introducing the steam and pulverized coal into a gasifier to react the coal and steam at a temperature above said minimum temperature throughout said gasifier.

24 Claims, 7 Drawing Figures

*Fig. 1. PRIOR ART*

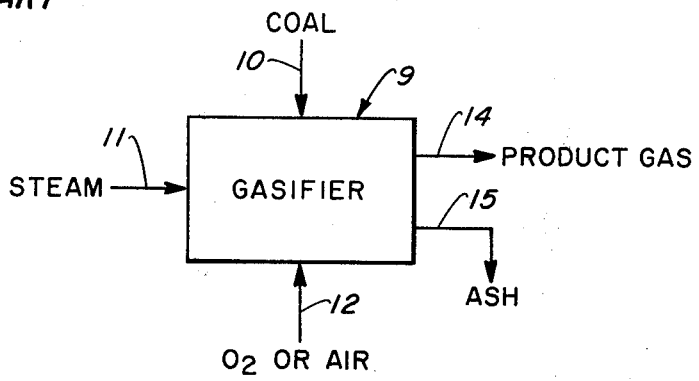

TYPICAL REACTION (1) $a\ O_2 + b\ C + c\ H_2O \rightarrow d\ CO + e\ H_2 + f\ CO_2$

OR (2) $a\ AIR + b\ C + c\ H_2O \rightarrow d\ CO + e\ H_2 + f\ CO_2 + g\ N_2$

*Fig. 2.*

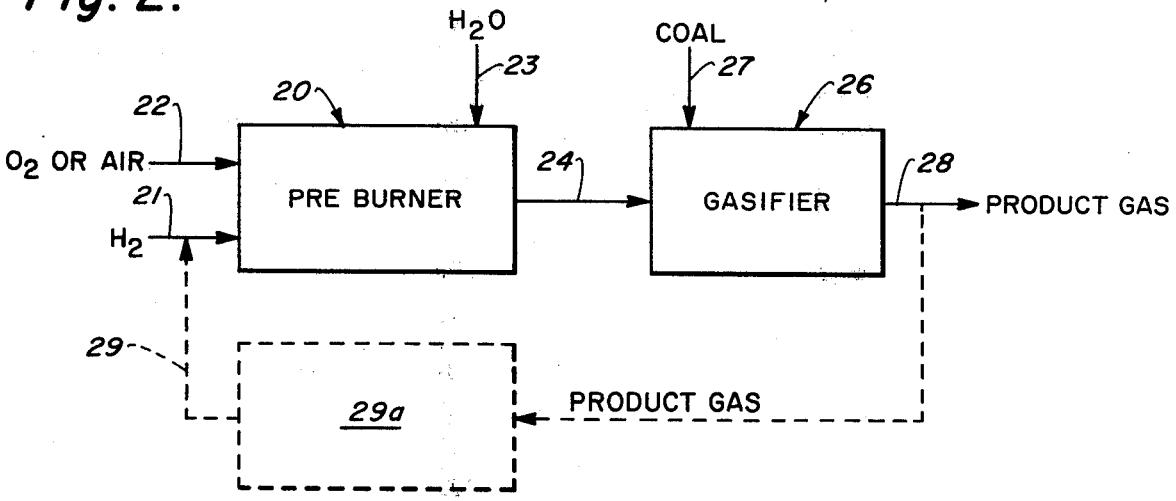

| OXIDIZER/FUEL | BASIC REACTION |
|---|---|
| • $O_2/H_2$ | (3) $a\ O_2 + b\ C + c\ H_2 \rightarrow d\ CO + e\ H_2$ |
| • $O_2$/PRODUCT GAS | (4) $a\ O_2 + b\ C + c\ H_2 + d\ CO \rightarrow e\ CO + f\ H_2$ |
| • AIR/$H_2$ | (5) $a\ AIR + b\ C + c\ H_2 \rightarrow d\ CO + e\ H_2 + f\ N_2$ |
| • AIR/PRODUCT GAS | (6) $a\ AIR + b\ C + c\ H_2 + d\ CO \rightarrow e\ CO + f\ H_2 + g\ N_2$ |

*Fig. 5.*

SYSTEM INPUT COMPARISON
(PER 1,000 SCF OF GAS PRODUCED)

| OXYGEN PROCESS | FUEL (COAL) LBS. | $H_2$ $FT^3$ | PG $FT^3$ | $O_2$ $FT^3$ | STEAM LBS. | $H_2O$ LBS. | OUTSIDE HEAT BTU |
|---|---|---|---|---|---|---|---|
| WITH $H_2$ | 18.8 | 144 | - | 153 | - | 8.8 | - |
| WITH PRODUCT GAS* | 22.5 | - | 634 | 314 | - | 1.2 | - |
| AIR PROCESS | | | | AIR $FT^3$ | | | |
| WITH $H_2$ | 8.7 | 173 | - | 613 | - | - | - |
| WITH PRODUCT GAS* | 9.9 | - | 280 | 662 | - | .52 | - |

*FIGURES ARE PRODUCT GAS RECYCLED AT 100°F PLUS 1,000 SCF OUTPUT

*Fig. 6.*

SYSTEM OUTPUT PRODUCT COMPARISON

| OXYGEN PROCESS | GAS COMPOSITION – % | | | | | BTU/SCF GROSS |
|---|---|---|---|---|---|---|
| | $H_2$ | CO | $CH_4$+ | $CO_2$ | $N_2$ | |
| WITH $H_2$ | 48.3 | 49.1 | 1.5 | 0.7 | 0.4 | 307 |
| WITH PRODUCT GAS | 35.9 | 61.4 | 1.7 | 0.7 | 0.3 | 307 |
| AIR PROCESS | | | | | | |
| WITH $H_2$ | 25.5 | 25.7 | 0.5 | 0.1 | 48.2 | 162 |
| WITH PRODUCT GAS | 20.2 | 33.9 | 0.9 | 0.7 | 44.3 | 171 |

*Fig. 7.*

OVERALL PERFORMANCE COMPARISON

| OXYGEN PROCESS | $/ THERM FOR ALL PROCESS FUELS | EFFICIENCY RATIO* = BTU IN PRODUCT / BTU IN RAW FUELS + OUTSIDE HEAT |
|---|---|---|
| WITH $H_2$ | 0.41 | 1.0 |
| WITH PRODUCT GAS | 0.40** | 0.53** |
| KOPPERS PULV. COAL | 0.58 | 0.58 |
| LURGI PRESSURE | 0.59 | 0.42 |
| WINKLER | 0.61 | 0.53 |
| BRUCETON | - | 0.59 |
| AIR PROCESS | | |
| WITH $H_2$ | 0.71 | 0.74 |
| WITH PRODUCT GAS | 0.13** | 0.67** |
| HOT RAW PRODUCER GAS | 0.24 | 0.64 |

*ADJUSTED TO 1.0 MAX. REFERENCE
**CORRECTED FOR AMOUNT OF GAS RECYCLED

COAL GASIFICATION PROCESS

BACKGROUND OF THE INVENTION

Present processes for the gasification of coal generally rely upon external sources of heat or the burning of part of the carbon (coal or coke) to provide the heat needed. This process results in the generation of $CO_2$ which, in most cases, must be removed from the stream output before the gas can be used. Also, slagging of U.S. coals presents a problem in present gasification processes. In the Lurgi process, sized non-coking coal is fed into a pressure gasifier and steam and oxygen are introduced below the grate at the bottom of the gasifier in amounts that will cool the grate and prevent clinking of the ash. The raw gases leave the top of the gasifier at about 850° F and are scrubbed and cooled before further treatment. The concurrent flow of the reactants in a fixed-bed reactor allows the efficient use of the heat released during the oxidation of the coal near the base of the gasifier. The Lurgi gasifier requires sized coal and can only handle non-coking coal. In the Koppers-Totzek process, coal, steam and oxygen in an entrained state are reacted at atmospheric pressure. Because of the entraining mode of operation, the raw gas leaves the gasifier at temperatures up to 3300° F so that the consumption of oxygen is higher than in fixed-bed processes. Additional processes, such as the Winkler process, are described in the article entitled "Coal Conversion Technology" by Harry Perry in Chemical Engineering, July 22, 1974 issue.

SUMMARY OF THE INVENTION

The present gasification process utilizes a precombustion stage in which an oxidizer and fuel are combusted to provide heat to a separate gasifier stage in which the classic carbon/water reaction takes place to produce CO and $H_2$ without the generation of $CO_2$ which would have to be removed from the product gas before the gas could be used. In the gasifier stage, slagging is avoided by utilizing powdered coal injected into the products of combustion which leave the precombustion stage and enter the gasifier. Ash is blown out of the gasifier and can be collected by a centrifical separator.

Very high temperature steam is produced in the precombustion (preburner) stage and the steam reacts with the coal in the gasifier stage. No significant $CO_2$ is produced in the product gas because $CO_2$ in the gasifier is reduced to CO at the high temperature of the incoming gas from the preburner. The temperature of the steam produced in the preburner will be determined by the nature of the fuel and oxidizer introduced to the preburner. It is desirable to have the products of combustion (steam) from the preburner at a temperature substantially higher than will maintain the gasification action so that as the reaction proceeds, the temperature in the gasifier will not drop below the temperature required to complete the production of CO and $H_2$. In order to maintain the gasification reaction throughout the gasifier, the temperature in the gasifier should not drop below about 1712° F at the discharge end of the gasifier stage. By burning the fuel and oxygen in a preburner outside of the gasifier, an ultra-high temperature environment is created in the gasifier so that any $CO_2$ is immediately reduced to CO.

As previously stated, the heat required for reaction in known processes is generated by burning part of the coal and oxygen or air, and this burning produces $CO_2$ because of the lower temperature of the combustion process. The gases move through a bed of coal and temperatures are such that $CO_2$ is formed. In order to hold down the percentage of $CO_2$, the temperature of the steam introduced is made as high as possible to reduce the amount of $O_2$ that has to be used.

In the present invention, a sudden expansion burner can be utilized to produce the very high preburner temperature. Such a burner is fully described in U.S. Pat. No. 3,074,469 and is capable of producing combustion products in the general temperature range of 5,000° F depending on the fuel and oxidizer which is used. The rate of introduction of powdered coal into the steam from the preburner is controlled to maintain the complete conversion of the coal to product gas containing CO and $H_2$ and substantially no $CO_2$. Obviously, it would be impossible to generate steam in a boiler to temperatures of this magnitude because of structural limitations in such devices. In some cases, additional steam can be added to that produced in the pre-burner when the steam temperature is high enough to react more coal than the combustion products could reduce.

BRIEF DESCRIPTION OF THE DRAWINGS

FIG. 1 is a diagrammatic illustration of a typical present coal gasification process and lists typical reactions in said process using oxygen or air;

FIG. 2 is a diagrammatic illustration of the process of the present invention and lists typical reactions with various fuel/oxidizer combinations;

FIG. 5 is a chart showing the input into the process for each thousand SCF of gas produced with the various fuel/oxidizer combinations in the pre-burner;

FIG. 6 is a chart of the system output product for the various fuel/oxidizer combinations;

FIG. 7 is a chart comparing the overall performance of the invention with prior art processes.

DESCRIPTION OF THE PREFERRED EMBODIMENT

Figure 3:
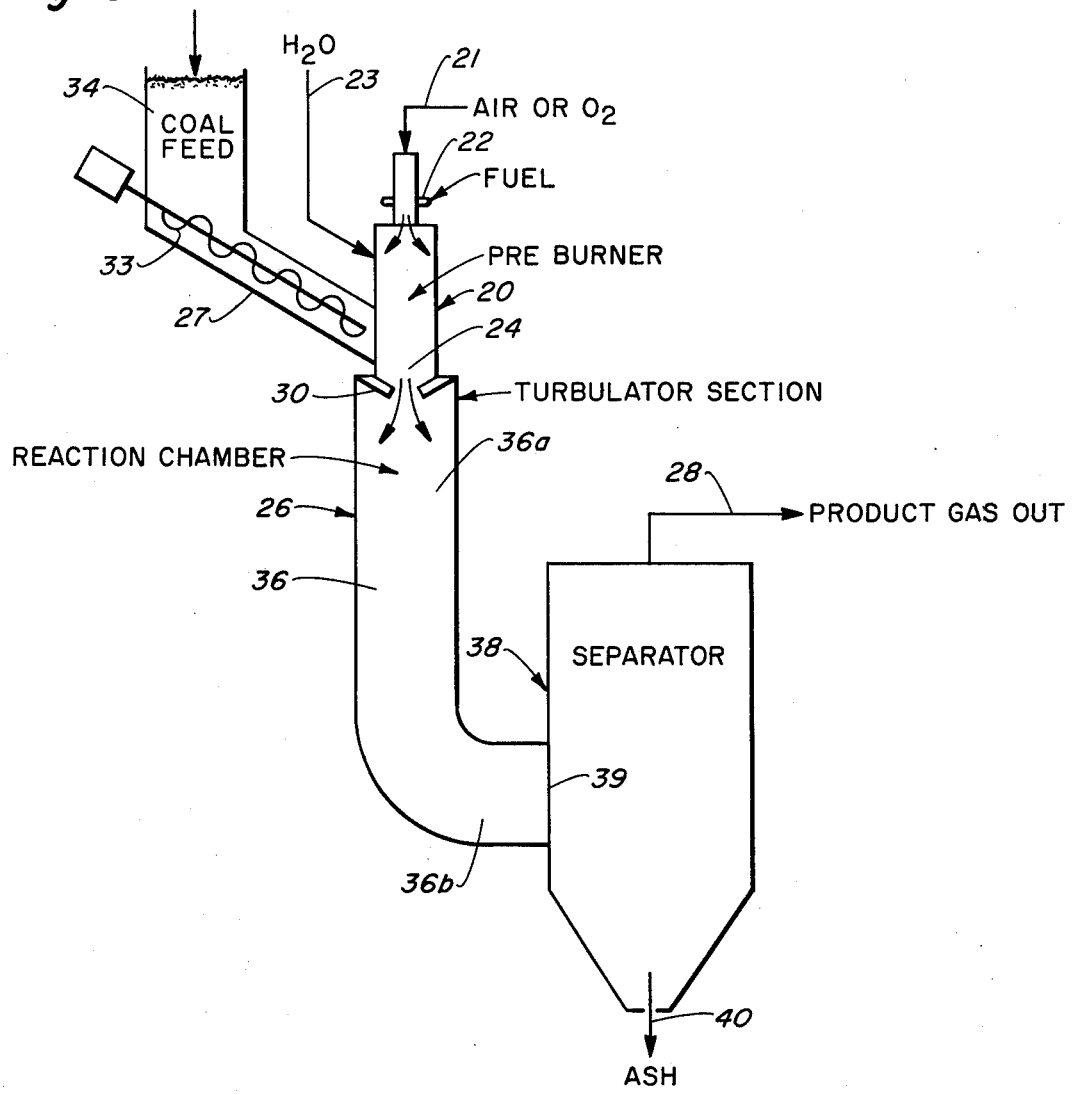
FIG. 3 is a diagrammatic illustration of an apparatus utilized to perform the process by introducing powdered coal into the combustion products of a sudden expansion burner.

FIG. 1 illustrates a typical prior art coal gasification process which utilizes a gasifier 9. Coal is introduced by passage 10, steam is introduced by passage 11, and an oxidizer (oxygen or air) is introduced by passage 12. The steam and oxidizer react with coal to produce a product gas which is discharged by passage 14 and ash is removed by passage 15. An axiliary burner (not shown) can be utilized to start the reaction. FIG. 1 also lists the typical reactions (1) and (2) when oxygen or air, respectively, is utilized and in each case, it is noted that $CO_2$ is produced in addition to fuel components $H_2$ and CO. Also, in the case of air, $N_2$ is also present in the product gas since it is a component of air and is inert in the process. No attempt is made to balance these equations, but the inputs are shown on one side and the components of the product gas are shown on the other side of the equations. The $CO_2$ present in the product gas has no BTU capacity and is incapable of being further utilized as a fuel product. The steam introduced by passage 11 is usually produced by a boiler and can have a temperature range of about 800° to 1500° F. The product gas is produced throughout the gasifier and leaves at a temperature somewhat above the entering temperature of the steam. The reaction is generated by burning part of the coal with oxygen or air and this produces $CO_2$ because of the lower temperature of the reaction. The hotter the steam, the less $CO_2$ will be formed and more CO will be formed. However, the introduction temperature of the steam is not high enough to produce a conversion of the coal to CO and $H_2$ without the formation of $CO_2$.

FIG. 2 illustrates the process of the present invention and of the reaction for each combustion of fuel and oxidizer introduced to the preburner 20. Fuel is introduced to the preburner by passage 21 and oxidizer is introduced by passage 22 and these substances are combusted in the preburner to produce steam in passage 24 at a very high temperature, depending upon the oxidants and fuel utilized. Some water at ambient temperature can be added at passage 23 and is converted into steam by the combustion products which also include steam. The total steam is then introduced to the gasifier 26 into which is simultaneously introduced powdered coal through passage 27. In the gasifier, a reaction takes place between the steam and the coal and produces CO and $H_2$ without any appreciable amount of $CO_2$, regardless of the particular combustion of fuel and oxidizer. When air is used as the oxidizer, inert $N_2$ is also present in the product gas. The product gas is then discharged through passage 28 to a separator and for further treatment. In one form of the invention, a portion of the product gas is recycled by passage 29 back to passage 22 so that the product gas serves as the fuel in the preburner. Reactions (3) and (4) of FIG. 2 utilized $O_2$ as the oxidizer and $H_2$ or product gas, respectively, as the fuel while reactions (5) and (6) used air as the oxidizer and $H_2$ or product gas, respectively, as the fuel.

The present process effectively eliminates $CO_2$ from the product gas by reacting powdered coal with very high temperature steam produced in the preburner. Any $CO_2$ which might be developed in the gasifier is immediately reduced to CO because of the very high temperature environment. The reaction takes place as the components move along the gasifier and the temperature in the gasifier is not permitted to fall below the minimum temperature which will maintain the gasification process, namely about 1712° F Thus, the product gas is discharged from the gasifier at a temperature at least as high as the minimum temperature. The amount of coal and steam introduced to the gasifier is such that the coal and steam will be substantially completely reacted to CO and $H_2$ and ash by the time the gas reaches the discharge passage 28. The coal is never in contact with pure oxygen and will never burn but merely reacts with high temperature steam to form CO and $H_2$.

Figure 4:
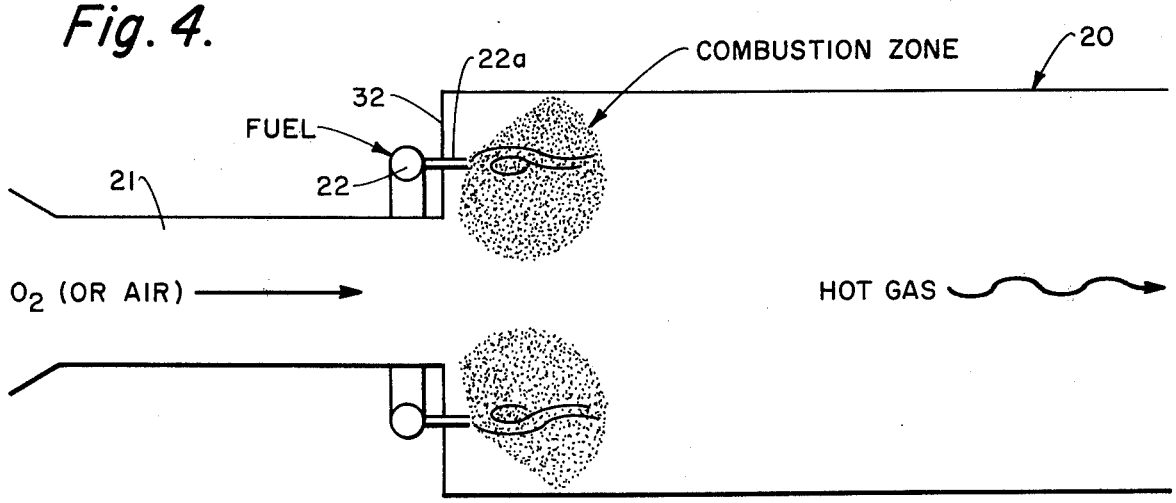
FIG. 4 is an enlarged diagrammatic illustration of the burner.

FIG. 3 is a diagrammatic illustration of one form of apparatus utilized to practice the process. The preburner 20 (see FIG. 4) is a sudden expansion burner, such as fully disclosed in U.S. Pat. No. 3,074,469. The oxidizer is introduced through passage 21 leading to the step 32 of the burner and the fuel is introduced from a manifold passage 22 through a plurality of passages **22*a* extending through the step 32. Combustion takes place at the step and beyond and water, if used, is added at passage 23. All the steam exits from the burner housing passage 24 and through turbulent section 30 where the steam mixes with powdered coal introduced through passage 27 by a motor driven screw 33 in coal hopper 34. The steam and coal enter at end of reaction chamber 36 of gasifier 26 and react as they pass downwardly from end 36*a* of the reaction chamber 36 to end 36*b*. The quantity of water added to burner passage 24 from passage 23 is such as to react the maximum amount of coal as determined by the steam temperature entering the gasifier. The amount of coal and steam introduced to the gasifier assures that the gasification reaction continues along chamber 36 and does not fall below approximately 1712° F by the time the reaction product reaches separator 38 connected to end 36b of the reaction chamber 36. By the time the reaction products enter the separator 38 through exit opening 39, the coal and steam will be completely reacted to $H_2$ and CO. The separator 38 can be of any standard construction which removes any solid particles and ash and the product gas leaves the separator through passage 28 at the top of the separator, the ash being discharged through bottom opening 40.**

Referring to the various reactions set forth in FIG. 2, when oxygen and hydrogen are combusted in the preburner 20, and the water added, the resultant steam temperature in passage 24 is approximately 3514° F. and when hydrogen is combusted with air, the temperature of steam is about 3100° F. When oxygen is combusted with product gas and a small amount of water added, the temperature is about 4722° F and when air is combusted with product gas and a small amount of water added the steam temperature is about 3770° F. It has been determined that the reaction of coal and steam to CO and $H_2$ requires a minimum temperature of approximately 1712° F and therefore the temperature of the steam produced by each of the reactions in FIG. 2 is high enough to reduce coal throughout the reaction chamber before the minimum reaction temperature is reached.

The amount of powdered coal fed to the gasifier in proportion with the flow of fuel and oxidizers to the preburner can be determined from the chart of FIG. 5. When 153 cubic feet of oxygen and 144 cubic feet of hydrogen gas are combusted in the preburner, and 8.8 pounds of water added, the steam product will be reacted with 18.8 pounds of coal. As indicated in FIG. 6, the product gas leaving the reaction chamber will be 48.3% $H_2$, 49.1% CO, 1.5% $CH_4$, 0.7% $CO_2$ and 0.4% $N_2$. The steam at approximately 3524° F will reduce 18.8 pounds of coal and this represents the optimum relationship between the quantities of fuel, oxidizer, water and coal. In a similar manner, the optimum amounts of fuel, oxidizer, water and powdered coal used for the other three reactions and the components of the product gas can be determined from FIGS. 5 and 6 for the other three reactions. When product gas is taken from passage 28 to be used as fuel, about 20% of the product gas produced is recirculated to the preburner and a heat exchanger **29*a* is placed in passage 29** which reduces the temperature of the product gas to about 400° F, thereby reclaiming a portion of the heat content of the recirculated product gas for other uses.

Without the addition of water as indicated in the chart of FIG. 5, the exit temperature from the preburner into the separator 38 would be such that the quantity of coal reacted could be increased if more $H_2$ and $O_2$ were present in the product gas. Therefore, in order to attain the most efficient operation, an amount of water is added to the combustion products of the preburner so that more coal can be reduced and still maintain the required minimum exit temperature. As indicated in FIG. 5, the pounds of $H_2O$ added to each reaction varies to obtain the most efficient operation of the system by reaction of additional water with coal without lowering the temperature below the minimum of 1712° F. As indicated, no water is added in the air process where air is burned with hydrogen. The reaction equations of FIG. 2 do not indicate the addition of water to the preburner since the equations simply designate hydrogen and oxygen as separate components.

In FIG. 5, it is possible to determine the optimum ratio between the various products used in the process. In the oxygen process with $H_2$, the ratio of cubic feet of $H_2$ to cubic feet of $O_2$ is approximately 0.94, the ratio of cubic feet of hydrogen to pounds of coal is approximately 7.7, and the ratio of cubic feet of hydrogen to pounds of water added is approximately 16.4. In the oxygen process with product gas, the ratio of cubic feet of product gas to cubic feet of oxygen is approximately 2.02, the ratio of cubic feet of product gas to pounds of coal is approximately 28.2, and the ratio of cubic feet of product gas to pounds of water added is approximately 528.33.

In the air process with $H_2$, the ratio of cubic feet of hydrogen to cubic feet of air is approximately 0.28, the ratio of cubic feet of hydrogen to pounds of coal is approximately 19.9 and no additional water is added at passage 23. In the air process with product gas, the ratio of cubic feet of product gas to cubic feet of air is approximately 0.42, the ratio of cubic feet of product gas to pounds of coal is approximately 28.3, and the ratio of cubic feet of product gas to water added is approximately 538.5. It is understood that the rate at which these components are employed in the process will depend upon the capacity of the equipment employed to conduct the process and that the figures listed in the chart of FIG. 5 are for 1000 SCF of product gas produced independently of the rate of production.

Referring to the chart of FIG. 6, the product gas composition in percentage of components is listed as well as the BTU per SCF of gas product produced. In all the reactions of FIG. 2, only a trace of $CO_2$ is present in the product gas regardless of the particular oxidizer and fuel. As would be expected, the BTU per SCF gross of the product gas is substantially higher with the burning of pure oxygen than with the burning of air as the oxidizer in the preburner.

While FIG. 5 sets forth the optimum proportions of fuel, oxidizer, water and powdered coal, the process is operative at other ratios. However, if the percentage of coal is lower, there is not sufficient carbon to combine with the steam and excess steam will be present in the product gas. If the percentage of coal is increased, the gases will be chilled more during the reaction and the temperature will drop so that there may be some $CO_2$, as well as ash and coal dust, in the outlet from the reaction chamber.

Referring to FIG. 7, there is set forth a comparison of the reactions used in the present invention with a number of prior art processes, whose performances are calculated from the best attainable information. The efficiency ratio of the BTU in the product to the BTU in the raw fuel plus outside heat is designated as 1 for the oxygen the process using hydrogen as fuel. The present process with the use of product gas and air provides a cheap process which compares very favorably with the hot raw producer gas process. In both of these cases, the product gas has a substantial percentage of nitrogen in the product gas which may limit the use of the product gas in other processes because it is practically impossible to remove the nitrogen. The oxygen processes do not have the nitrogen in the product gas because air is not used as the oxident. The processes of the present invention have the added advantage that the product gas does not contain any substantial amount of $CO_2$ as in the other oxygen processes to which it is compared.

An important aspect of the present process is the fact that by using a continuous coal feed, any type of coal can be used without plugging up the gasifier. While this is probably also true of the Koppers' process, the Koppers' process still has a substantial quantity of $CO_2$ in its product gas. Also, both of the processes using oxygen with $H_2$ or product gas are considerably more efficient on a dollar per therm basis than the Koppers and other prior processes to which they are compared.

The coal can have the consistency of beach sand or finer, but if the coal is too large, particles will fall, partically unreacted, to the bottom of the chamber. The absence of any substantial $CO_2$ in the product gas has a considerable advantage in that it does not have to be removed for processes in which the $CO_2$ would be ineffective or objectionable. Heat can be recovered from the high temperature product gas by a waste heat boiler or heat exchanger with the incoming air. While ratios of oxygen, hydrogen and air and product gas, as supplied to the preburner have been described for the optimum condition, variations can take place and still produce an operating process although such variations from the optimum would not be practical.

What is claimed is:

1. A process for the gasification of coal comprising the steps of:
   a. combusting a hydrogen containing fuel and oxidizer selected from the group consisting of oxygen and air in a preburner to produce steam at a temperature substantially above the minimum temperature at which steam will react will coal to produce carbon monoxide and hydrogen, said minimum temperature being approximately 1712° F;
   b. introducing said steam and pulverized coal into a gasifier in controlled amounts and reacting the coal and steam in a substantially oxygen free environment while maintaining the reaction temperature above said minimum temperature throughout said gasifier; and
   c. discharging product gas comprising CO and $H_2$ from said gasifier at approximately said minimum temperature, the controlled amounts of said coal and said steam introduced to the gasifier being such that the coal and steam are substantially completely reacted to CO and $H_2$ and ash by the time of discharge.

2. A process as defined in claim 1 comprising discharging said product gas from said gasifier at said minimum temperature of approximately 1712° F.

3. A process as defined in claim 1 wherein said fuel is product gas removed from said gasifier.

4. A process as defined in claim 1 comprising combusting said fuel and oxidizer in a sudden expansion burner.

5. A process as defined in claim 1 comprising mixing said steam and pulvarized coal together in turbulent passage section upon entering said gasifier.

6. A process as defined in claim 1 comprising introducing said product gas to a separator to remove ash particles from said product gas.

7. A process as defined in claim 1 comprising adding a quantity of water to said burner to increase the quantity of steam reacted with said coal in said gasifier to an amount which will react the maximum quantity of coal.

8. A process as defined in claim 7 wherein said fuel and oxidizer are hydrogen and oxygen, respectively, the temperature of said introduced steam being approximately 3514° F.

9. A process as defined in claim 7 wherein the ratio of cubic feet or hydrogen to cubic feet of oxygen is approximately 0.9, the ratio of cubic feet of hydrogen to pounds of coal is approximately 8, and the ratio of cubic feet of hydrogen to pounds of water added is approximately 16.

10. A process as defined in claim 9 wherein and product gas is removed at a temperature of approximately 1712° F, said product gas being comprised of $H_2$ and CO with only a trace of $N_2$ and $CO_2$.

11. A process as defined in claim 10 wherein said product gas has a BTU per SCF value of approximately 307.

12. A process as defined in claim 7 wherein said fuel and oxidizer are product gas and oxygen, respectively, the temperature of said introduced steam being approximately 4722° F.

13. A process as defined in claim 12 wherein the ratio of cubic feet of product gas to cubic feet of $O_2$ is approximately 2, the ratio of cubic feet of product gas to pounds of coal is approximately 28, and the ratio between cubic feet of product gas to pounds of water added is approximately 528.

14. A process as defined in claim 12 wherein said product gas is removed at a temperature of approximately 1712° F, said product gas being comprised of $H_2$ and CO with only a trace of $N_2$ and $CO_2$.

15. A process as defined in claim 14 wherein said product gas has a BTU per SCF value of approximately 307.

16. A process as defined in claim 1 wherein said fuel and oxidizer are hydrogen and air, respectively, the temperature of said introduced steam being approximately 3100° F.

17. A process as defined in claim 16 wherein the ratio of cubic feet of hydrogen to cubic feet of air is approximately 0.3 and the ratio of cubic feet of hydrogen to pounds of coal is approximately 20.

18. A process as defined in claim 17 wherein said product gas is removed at a temperature approximately 1712° F, said product gas comprising $H_2$ and CO and $N_2$ with only a trace of $CO_2$.

19. A process as defined in claim 18 wherein said product gas has a BTU per SCF of approximately 162.

20. A process as defined in claim 7 wherein said fuel and oxidizer are product gas and air, respectively, the temperature of said introduced steam being approximately 3770° F.

21. A process as defined in claim 20 wherein the ratio of cubic feet of product gas to cubic feet of air is approximately 0.4, the ratio of cubic feet of product gas to pounds of coal is approximately 28, and the ratio between cubic feet of product gas to pounds of water added is approximately 538.

22. A process as defined in claim 21 wherein said product gas is removed at a temperature of approximately 1712° F, said product gas comprising $H_2$ and CO and $N_2$ with only a trace of $CO_2$.

23. A process as defined in claim 22 where said product gas has a BTU per SCF of approximately 171.

24. A process as defined to claim 1 comprising introducing said steam to said gasifier at a temperature high enough to create an environment capable of immediate reduction of $CO_2$ to CO.

* * * * *